United States Patent [19]

McCain et al.

[11] 4,451,031

[45] May 29, 1984

[54] SIGNATURE MACHINES

[75] Inventors: William B. McCain, Hinsdale; Thomas A. Nelson, Oak Lawn, both of Ill.

[73] Assignee: McCain Manufacturing Corporation, Chicago, Ill.

[21] Appl. No.: 340,361

[22] Filed: Jan. 18, 1982

[51] Int. Cl.[3] ..... B65H 29/66

[52] U.S. Cl. ..... 271/303; 271/202; 271/216

[58] Field of Search ..... 271/280, 289, 290, 303, 271/202, 203, 216, 149, 151; 198/644

[56] References Cited

U.S. PATENT DOCUMENTS

| | | | |
|---|---|---|---|
| 3,623,722 | 11/1971 | Sjogren | 271/303 |
| 4,034,976 | 7/1977 | Lundblad | 271/274 X |
| 4,200,276 | 4/1980 | Marschke | 271/202 X |
| 4,283,048 | 8/1981 | Muller | 271/303 |
| 4,369,959 | 1/1983 | Hornbuckle | 271/274 X |

*Primary Examiner*—Richard A. Schacher

*Attorney, Agent, or Firm*—Kinzer, Plyer, Dorn & McEachran

[57] ABSTRACT

Extraneous signatures in a continuous stream are purged by so diverting the stream that it is possible at the same time to originate and advance the head of a new stream to the point of diversion.

5 Claims, 4 Drawing Figures

SIGNATURE MACHINES

This invention relates to signature machines and in particular to the part of the machine which feeds the signatures from a supply magazine to a so-called pocket feeder. The pocket feeder in turn delivers the signatures one by one to the gatherer which sequentially gathers or collects the signatures from the various pockets, one atop another, to complete the book, usually a magazine.

McCain U.S. Pat. No. 4,177,982 discloses and claims a signature feeder of the sort comprehended under the present invention. In that feeder a continuous stream of overlapped signatures is maintained between a supply station and the delivery or drop-off station where the signatures fall by gravity, one by one, for delivery into a terminal feeder pocket or hopper, one signature behind the other. The terminal hopper or pocket is associated with means to deliver the signatures one by one to the gathering chain on which the signatures are collected one atop another to complete the book, which is usually a magazine.

The machine of the aforesaid patent has proven to be eminently satisfactory and has attained considerable commercial success and recognition in the field. One object of the present invention is to enhance the productivity of that machine by enabling the attendant operator quickly and effectively to accommodate regional changes in the signatures being delivered. Such regional changes may be necessitated, for example, due to a signature having limited geographical significance such that the signature delivery sequence involved with the prevailing order of signatures reaches a point where the regional requirements for that order have been satisfied, necessitating a change in the order of the signatures being delivered. Explanation of the foregoing object in terms of "regional" distribution is only an example; there may be many different reasons for interrupting the prevailing order of signatures to enable a substitution to be made and other examples are "reader interest," "consumer interest," "professional interest," and so on. These various needs can be collectively identified as demographic needs. Therefore another and broader object of the invention is to enable the stream of signatures moving from a supply station to a delivery station to be discontinued to allow substitution of a different order of signatures and to divert to a reservoir or receiver the discontinued signatures. A related object of the invention, related to both of the objects just set forth, is to make the change, diverting the extraneous signatures at an increased speed.

IN THE DRAWINGS

Figure 1:
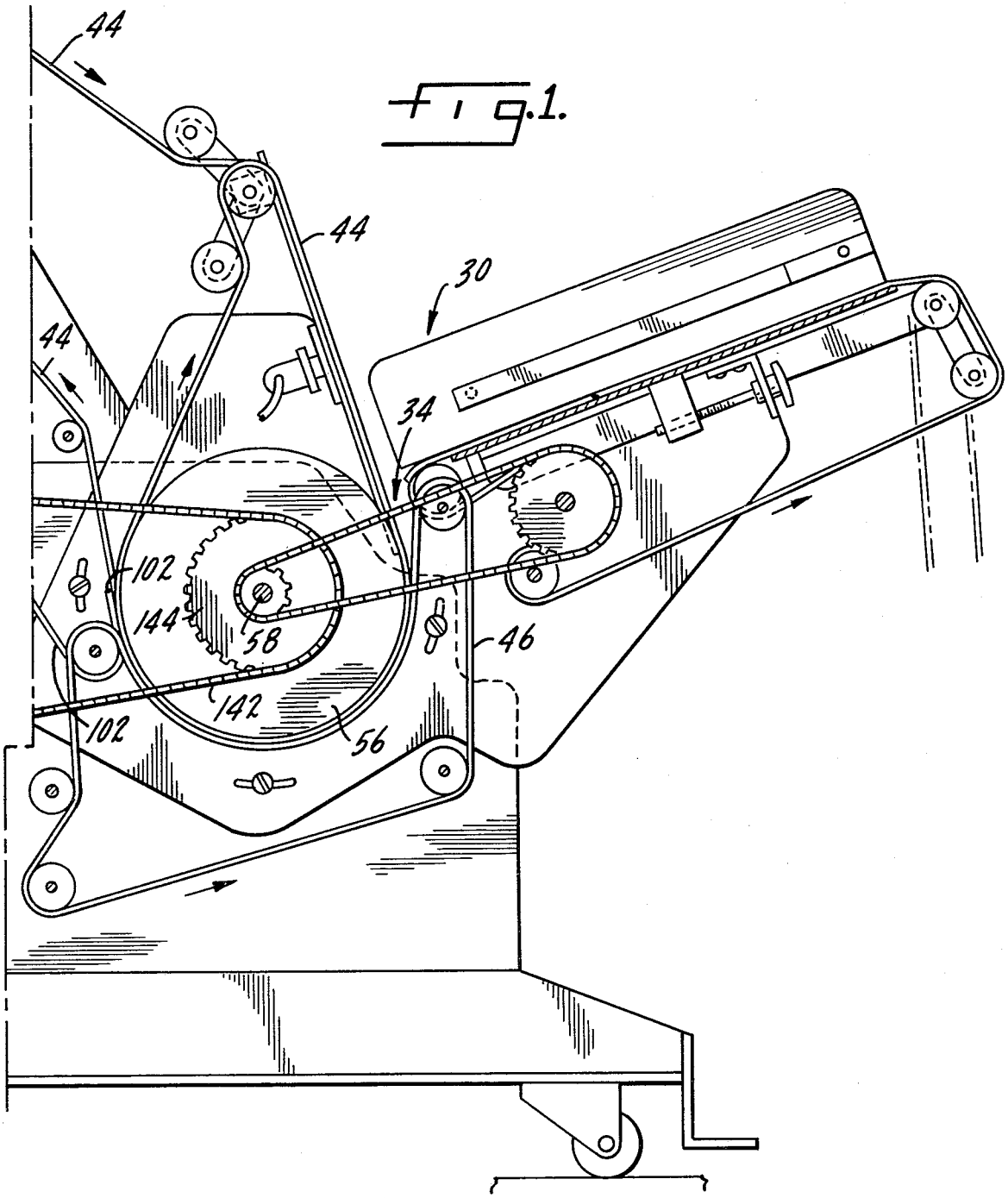
FIGS. 1 and 2 are complementary aft and forward side sectional views, respectively, of the machine.

FIG. 1 of the drawing is based on FIG. 1A of McCain U.S. Pat. No. 4,177,982 and indeed many of the reference characters are the same. The description immediately following is also founded on the corresponding description in U.S. Pat. No. 4,177,982.

Figure 2:
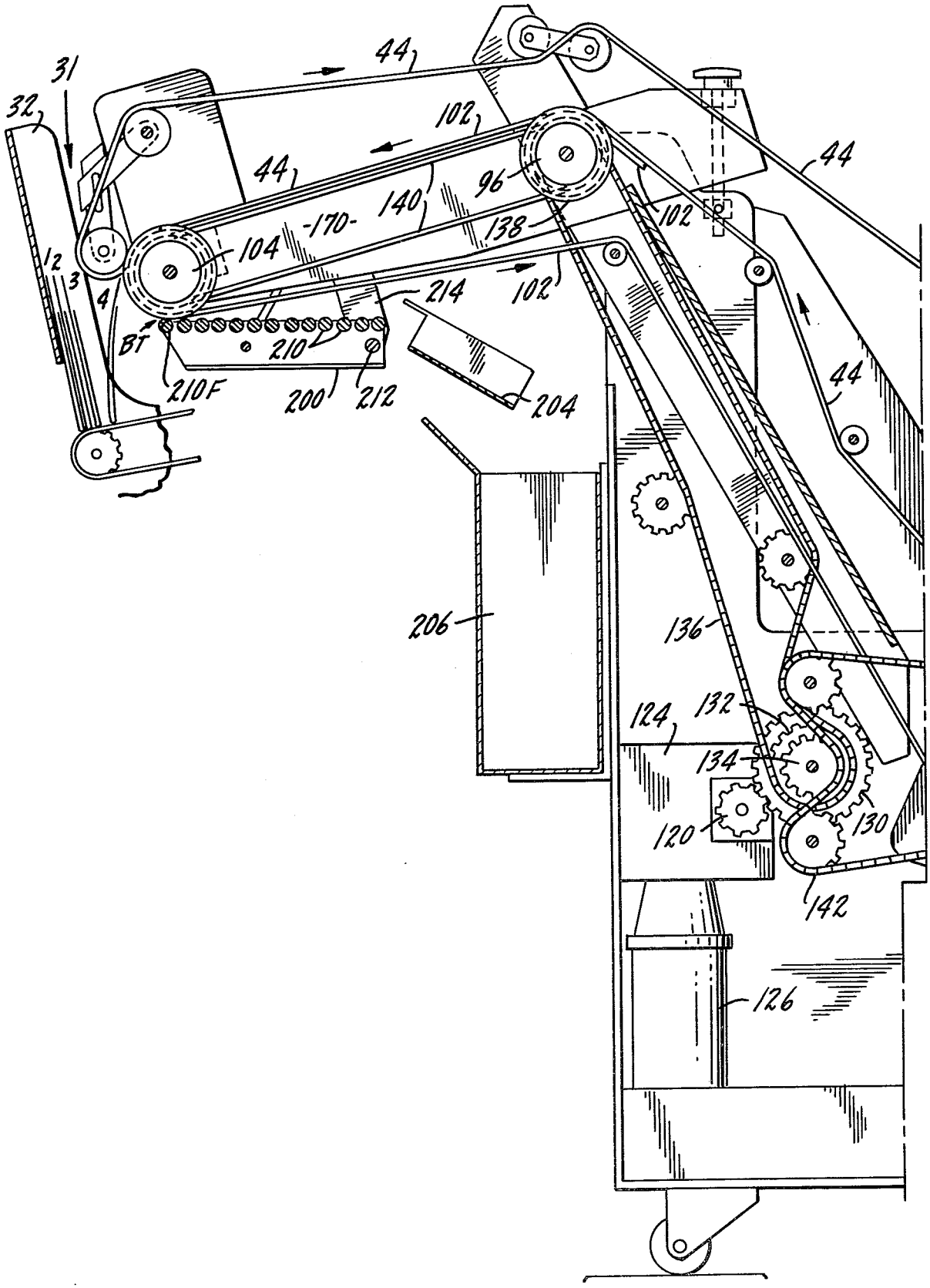

Signatures of the prevailing order moving through the machine are supplied from a hopper at a supply station 30, FIG. 1, and are eventually deposited at a delivery station 21, FIG. 2, which includes the back plate of a feed hopper 32. The feed hopper 32 will supply signatures to the gathering chain of a signature gatherer for the purpose of completing a book.

The signatures (not shown) are in a stack at the supply station 30 with their backbones or folded edge downwardly. They are advanced one by one through a feed gate 34, into the bite (nip) presented by opposed feed belts 44 and 46. The signatures clamped between the feed belts 44 and 46 are in an overlapped relation and this is accomplished in a manner explained in the McCain patent.

Eventually, as shown in FIG. 1, the feed belts 44 become associated with a related pair of feed belts 102 between which the overlapped signatures continue to be captured and it is the feed belts 44 and 102 which are responsible for passing the continuous stream of overlapped signatures upwardly, FIG. 1 and FIG. 2, and then in a generally forward horizontal direction, FIG. 2, in the direction of the delivery station 31.

The feed belts 44 and 102 are endless and are trained around various feed or drive wheels (pulleys) associated therewith including the large feed (driven) wheel 56, FIG. 1, the driven wheels 96 and the reversing wheels 104, FIG. 2, which direct the signatures toward the discharge or delivery station 31. Various tensioners and idlers are employed as will be evident from FIG. 2, all cooperating to present an effective terminal feed bite between the belts 44 and 102 to point the signatures into the discharge position, one behind the other, as denoted by the numbers 1, 2, 3 and 4, FIG. 2.

A chain drive is employed to drive the wheels 56 and 96. To this end a main driving gear 120, FIG. 2, is driven through a gear reducer 124 by a motor assembly 126. Gear 120 is meshed with a larger gear 130 which drives two coaxial sprockets 132 and 134. Sprocket 132 drives a chain 136 which drives a sprocket 138 secured to the shaft which supports the conveyor belt drive wheels 96 and this same drive is transmitted to wheels as 104 by a timing belt 140 so the wheels 104 are synchronized to the wheels 96. Sprocket 134 drives a chain 142 which in turn drives a sprocket 144 secured to shaft 58 which supports the wheels 56, FIG. 1.

The foregoing is described in more detail in U.S. Pat. No. 4,177,982 and all the reference characters referred to, are the same as in the patent.

Figure 4:
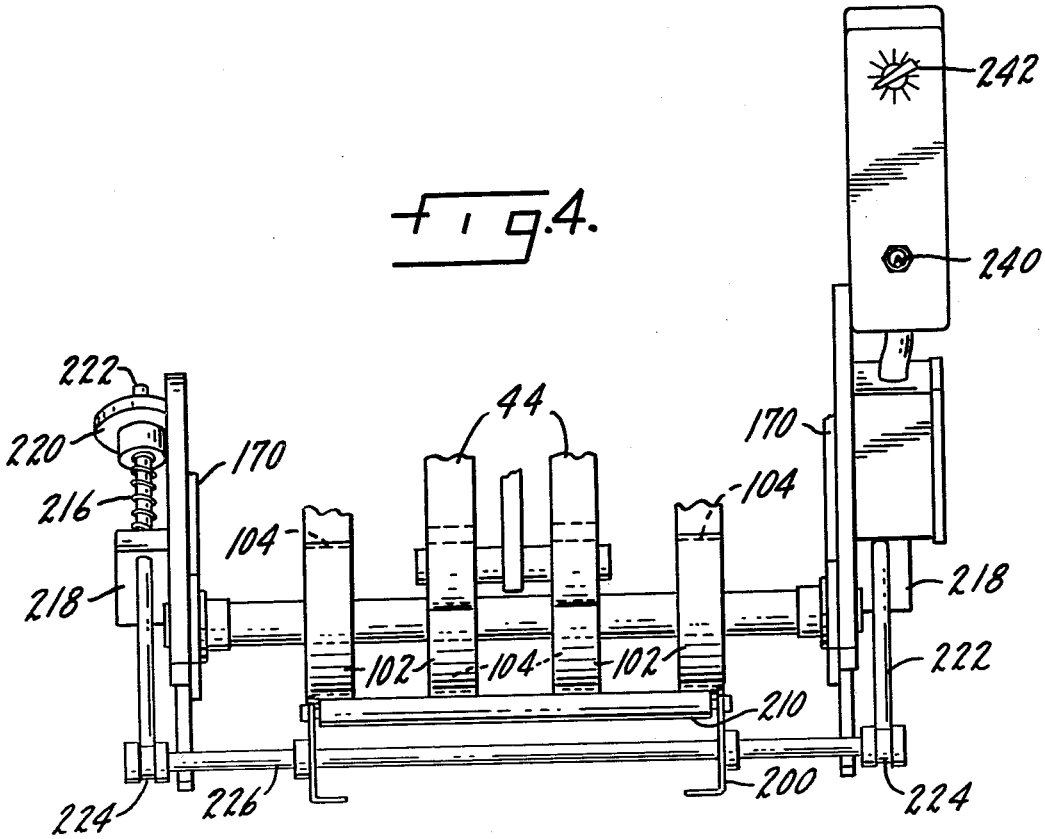
FIG. 4 is a detail view showing features of the invention.

The productivity of the machine may be enhanced as will now be described in detail by reference principally to FIG. 4.

The point of discharge from the conveyor means into the feeder pocket 32 may be considered to be the forwardmost bite of the feed belts 102 and 44, FIG. 2. It is at this point that the machine of the patent is altered or modified in accordance with the present invention and such modification is manifest in a guide means beneath the discharge conveyor structure, characterized by a roller supporting frame 200, a guide chute 204 positioned rearward thereof and a receiver 206 for collecting signatures of the prevailing order which are to be purged and not delivered to the feed hopper or pocket 32.

The frame 200 includes a pair of spaced side plates serving to support the journals of a plurality of elongated, idling guide rollers 210. The frame 200 is itself pivotally supported on a pin 212 and forwardly thereof is suspended by a pair of brackets 214 in turn secured to the frame plate 170, FIG. 2, which supports the conveyor means, guide rollers and pulleys.

Figure 3:
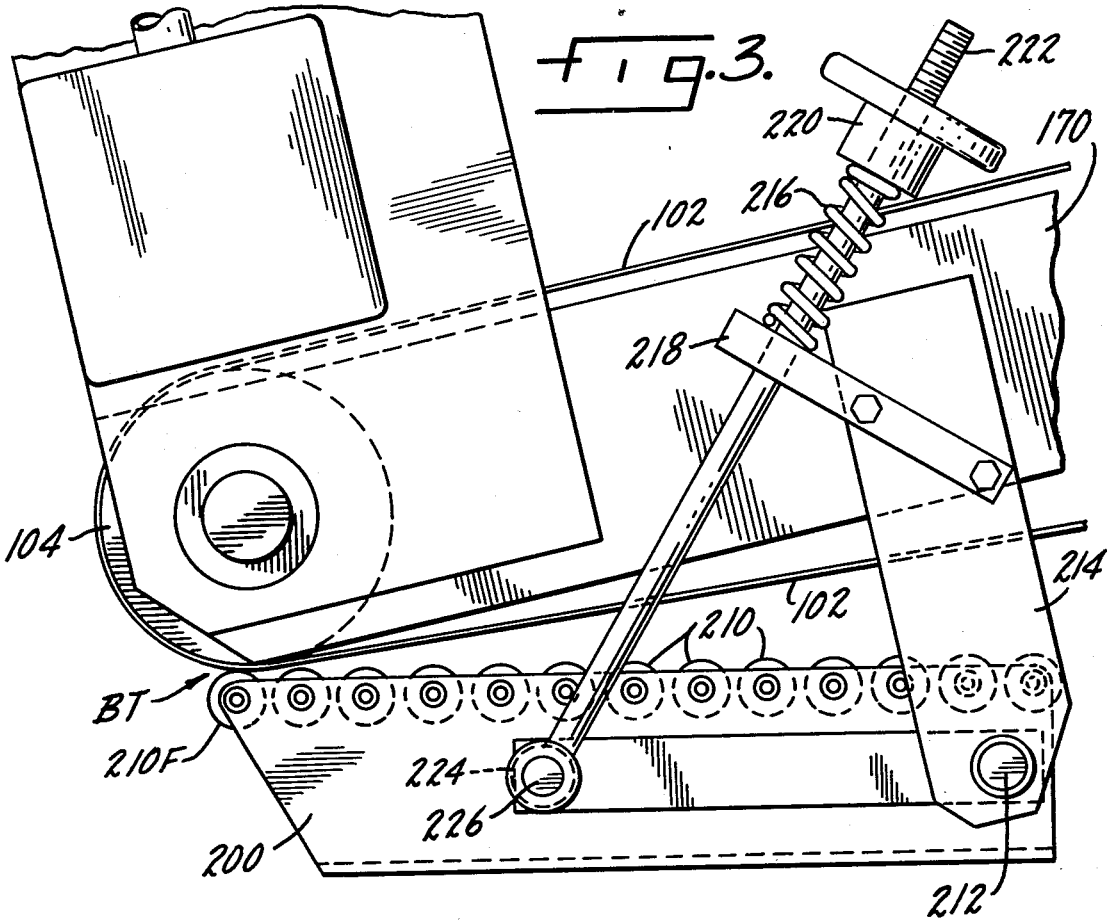
FIG. 3 is a fragmentary elevation showing features of the present invention.

The frame 200 is normally urged clockwise about the pivot pin 212 so that the leadingmost guide roller 210F is in driven contact with the lower run of the feed belts 102, which is to say that during normal operation of the machine with the frame 200 in the position shown in FIG. 3, roller 210F will be turning in a clockwise direction, defining a feed bite BT with the opposed feed belts 102. This position of the frame 200 is maintained by compressed coil springs as 216 on opposite sides of the machine, each having the lower end engaged with a related spring stop 218 while the upper end bears against a related collar assembly 220 threaded onto the upper end of a related rod 222 passed through an opening in the related stop 218. Each stop 218 is secured to the frame plate 170. The collar assembly may be turned on the rod 222 accordingly to vary the degree of compression of spring 216. The rod 222, as noted, passes through the stop 218 and its lower end is threadedly attached to a collar 224 pivotally mounted on a shaft 226 projecting laterally from the side of the plates which constitute the guide frame 200.

Accordingly, spring 216 in its compressed state is effective to apply an upward thrust in effect to rod 222 which in turn urges the frame 200 clockwise as viewed in FIG. 3 to present roller 210F to the lower run of the conveyor belts 102.

It will be seen that by applying a downward force to the collar 220, the bite BT may be opened and this enables the attendant to physically bend the leading group of signatures into the bite BT so that the signatures at the discharge point, instead of being directed into the feed pocket 32, are diverted rearward in the direction of the receiver 206. This will be done when the machine is temporarily stopped.

Assuming that manually bending the leading group of signatures into the bite has been completed and the drive to the conveyor belts re-established, the continuation of feeding of signatures will be rearward along the guide rollers 210, from thence to the chute 204, and from thence into the receiver or reservoir 206. This diversion of the signature stream is maintained by the friction of bite BT that normally prevails between the leadingmost guide roller 210F and the lower path or run of the feed belts 102, which is to say that when the signatures are in the bite BT the drive of the feed belts 102 is effective, in combination with the leadingmost idler roller 210F, to result in the signatures being diverted to the receiver 206.

The diversion mode just mentioned, for purging the signatures, will be undertaken when the attendant perceives that the demographic requirements for the prevailing order of signatures has been attained or will soon be attained by the remaining signatures at the delivery pocket 31–32, FIG. 2. This realization will be signaled or can be determined in many different ways and when the event occurs the attendant will ordinarily stop the machine. This can be done by actuating a control switch 240 which stops the variable speed motor 126. Having stopped the machine, the attendant intervenes further by applying muscle to the handles as 220 forcing the guide frame 200 downwardly to open the diversion bite BT and the attendant further intervenes by manually bending the leading group of the signatures into the bite thus opened so that the forwardmost part of the signature stream is now directed rearwardly through the bite BT in the direction of the receiver 206. Of course it is possible to construct the machine with pivoting guides so contoured as to produce the aforementioned bend for diversion but in most instances it is preferred this be accomplished manually at the time the machine of necessity must be stopped in order that the diversion bite may be opened and put into effect.

Having accomplished this, the upstream signatures located between the diversion point and the supply hopper 30, FIG. 1, are now to be purged (removed that is) and at the same time the attendant will stuff the supply hopper 30 with the new order of signatures.

Further to enhance productivity in accordance with the present invention, the attendant may then actuate a second switch 242 which will result in the variable speed motor 126 being driven at an accelerated rate, thereby rapidly to purge the unnecessary signatures. This will also feed the leading signatures of the new order at the same increased rate. When the attendant perceives that the leadingmost one of the new order of signatures is at the threshold of the diversion point, or quite near to it, he will stop the machine by actuating switch 240. Having stopped the machine, the trailingmost ones of the signatures being purged may then be manually pushed around the diversion point and through bite BT so that bite BT is cleared, and of course this will be done by depressing the guide frame 200 again to open the feed bite BT so the last of the signatures being purged may be pushed in the direction of the collector or receiver 206. After this has been done the drive motor will be re-engaged by actuating switch 240 after switch 242 has been reset to return the feed motor to its normal operating speed, feeding the new order of signatures into the delivery pocket 32.

We claim:

1. In a signature feeding machine which includes conveyor means and a selectively variable speed conveyor drive and feed means for maintaining a continuous stream of overlapped signatures at a substantially constant feed rate from a supply hopper up to and including a discharge position where the signatures are dropped one by one into a feed hopper which supplies a signature gatherer, and wherein an operator by intervention may interrupt the flow of signatures of the prevailing order into the feed hopper while substituting in the supply hopper a new order of signatures:

means to purge the upstream signatures located between the discharge position and the supply and comprising a receiver spaced from said discharge position and to which the purged signatures are to be diverted, guide means spaced from the conveyor means and located adjacent the receiver for guiding the purged signatures to the receiver, and means selectively to increase the speed of the drive and feed means and consequently the speed of the conveyor means during diversion.

2. Signature feeding machine according to claim 1 in which the conveyor means includes a substantially horizontal run of endless feed belts trained around support rollers located at the discharge position and in which the guide means includes a set of elongated guide rollers with a leading one of said guide rollers substantially in bite contact with the lower run of the feed belts at the discharge position whereby signatures at the discharge position may be diverted into said bite.

3. Signature feeding machine according to claim 2 in which the guide rollers are idler rollers supported in a frame pivotally mounted beneath the conveyor means, and spring means urging the frame upwardly so the first one of said guide rollers is in driven contact with the feed belts and therewith defines said bite.

4. Signature machine according to claim 3 including means to stop the motor so the frame may be manually lowered to open the bite to enable the signatures at the discharge position to be bent around the feed belts and into the opened bite.

5. In a signature feeding machine which includes a conveyor means and a selectively variable speed conveyor drive and feed means for maintaining a continuous stream of overlapped signatures at a substantially constant feed rate from a supply hopper up to and including a discharge position where the signatures are dropped one by one into a feed hopper which supplies a signature gatherer, and wherein an operator by intervention may interrupt the flow of signatures of the prevailing order into the feed hopper while substituting in the supply hopper a new order of signatures, an improved method for increasing productivity of said machine when there is to be a change in the order of the signatures characterized by diverting the prevailing stream of overlapped signatures to a receiver, increasing the speed of feeding signatures to the point of diversion, substituting in the supply hopper a new order of signatures while maintaining the increased speed of feed until the first of the new order of signatures has achieved the point of diversion, and afterwards reestablishing the previous feed rate.

* * * * *